US005460482A

United States Patent [19]

Dorsch

[11] Patent Number: 5,460,482

[45] Date of Patent: Oct. 24, 1995

[54] CENTRIFUGAL CHOPPER PUMP WITH INTERNAL CUTTER

[75] Inventor: Glenn R. Dorsch, Aberdeen, Wash.

[73] Assignee: Vaughan Co., Inc., Montesano, Wash.

[21] Appl. No.: 284,140

[22] Filed: Aug. 4, 1994

Related U.S. Application Data

[63] Continuation-in-part of Ser. No. 132,117, Oct. 5, 1993, which is a continuation-in-part of Ser. No. 889,519, May 26, 1992, Pat. No. 5,256,032.

[51] Int. Cl.[6] ..... F01D 5/04

[52] U.S. Cl. ..... 415/121.1

[58] Field of Search ..... 415/121.1

[56] References Cited

U.S. PATENT DOCUMENTS

| | | | |
|---|---|---|---|
| 2,265,758 | 12/1941 | Klosson . | |
| 2,714,354 | 8/1955 | Farrand . | |
| 2,934,023 | 4/1960 | Lamkin et al. . | |
| 3,155,046 | 11/1964 | Vaughan . | |
| 3,325,107 | 6/1967 | Peterson . | |
| 3,340,812 | 9/1967 | Schlesiger . | |
| 3,444,818 | 5/1969 | Sutton . | |
| 3,447,475 | 6/1969 | Blum . | |
| 3,915,394 | 10/1975 | Ferguson, Jr. | 241/185 |
| 3,973,866 | 8/1976 | Vaughan | 415/121 |
| 4,378,093 | 3/1983 | Keener | 241/46 |
| 4,430,214 | 2/1984 | Baker . | |
| 4,527,947 | 7/1985 | Elliott | 415/121 |
| 4,575,308 | 3/1986 | Corkill | 415/213 |
| 4,842,479 | 6/1989 | Dorsch | 415/121.1 |
| 5,256,032 | 10/1993 | Dorsch | 415/121.1 |

FOREIGN PATENT DOCUMENTS

| | | | |
|---|---|---|---|
| 729917 | 3/1966 | Canada . | |
| 759186 | 1/1934 | France . | |
| 1323707 | 6/1963 | France . | |
| 2515411 | 10/1975 | Germany . | |
| 55-117094 | 9/1980 | Japan | 415/121.1 |
| 90951 | 11/1937 | Sweden | 415/121.1 |
| 1332-077 | 8/1987 | U.S.S.R. | 415/121.1 |
| 1551918 | 9/1979 | United Kingdom . | |

OTHER PUBLICATIONS

Vaughn Company, Inc., *General Notes on Adding an Integral Cutter to a Vaughan Cutter Bar in The Field,* (1987).

*Primary Examiner*—John T. Kwon

*Attorney, Agent, or Firm*—Christensen, O'Connor, Johnson & Kindness

[57] ABSTRACT

Stationary cutter teeth project axially inward into the bowl of a centrifugal pump and cooperate with edge portions of the pump impeller vanes at the closed side of the pump bowl for chopping solid matter in the material being pumped.

21 Claims, 16 Drawing Sheets

Fig. 5.
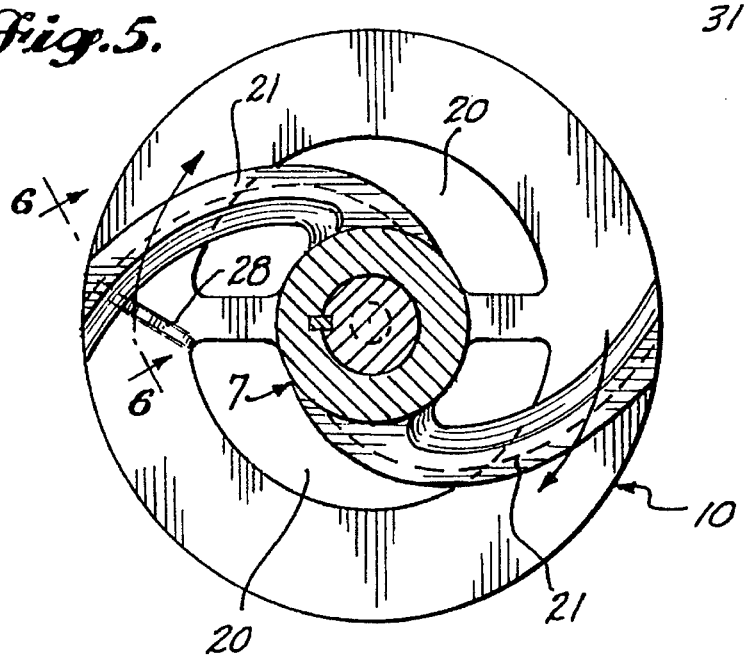
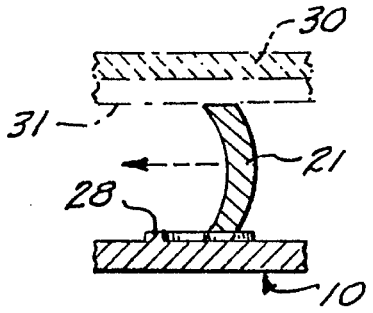
Fig. 6.
Fig. 7.
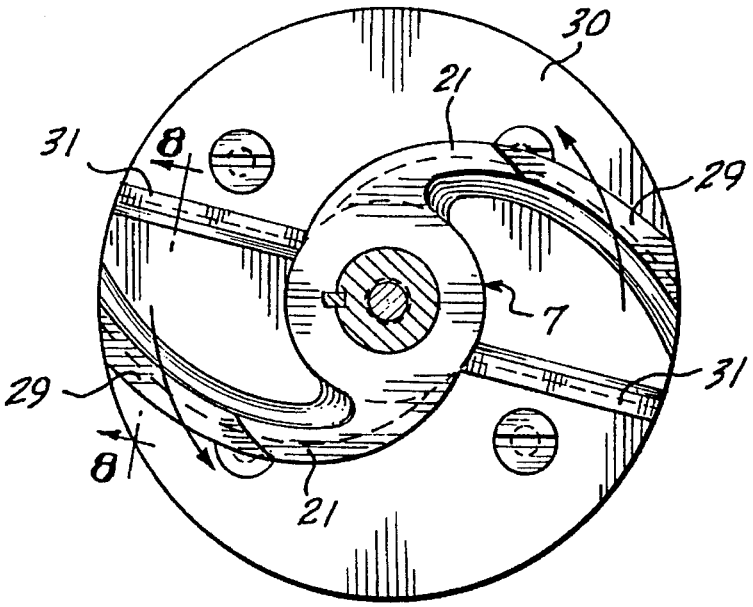
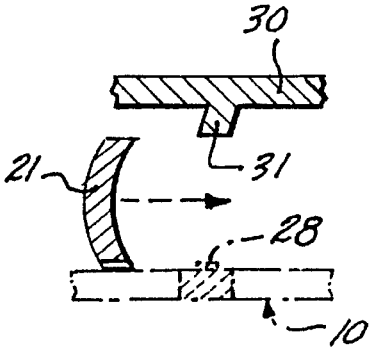
Fig. 8.

Fig.10.
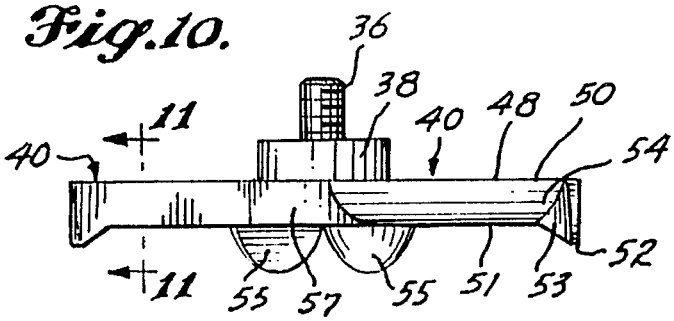
Fig.11.
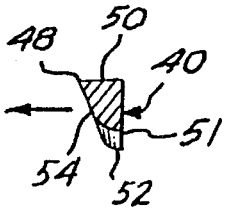
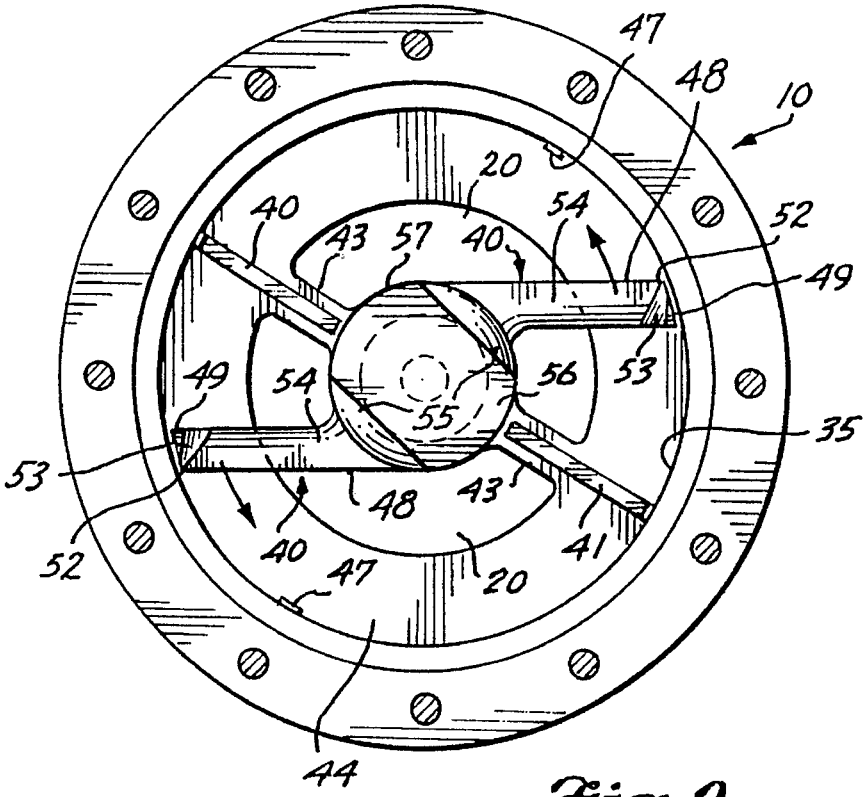
Fig.9.

Fig. 25.
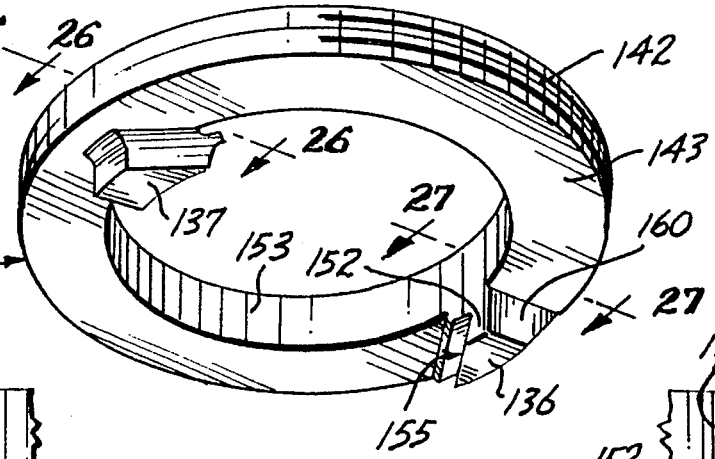
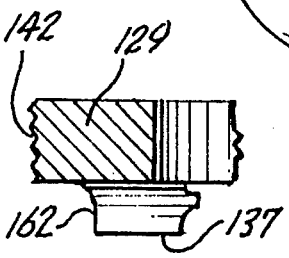
Fig. 26.
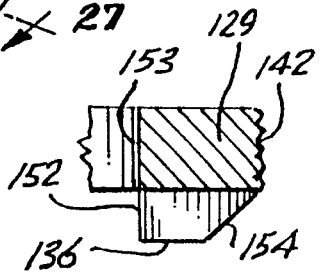
Fig. 27.
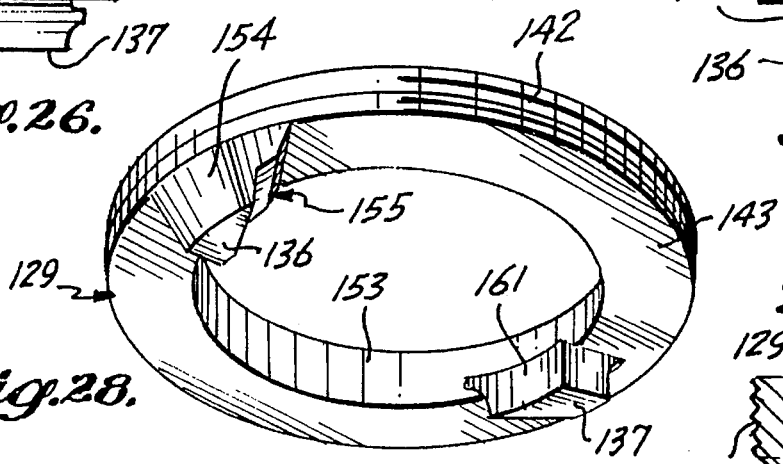
Fig. 28.
Fig. 31.
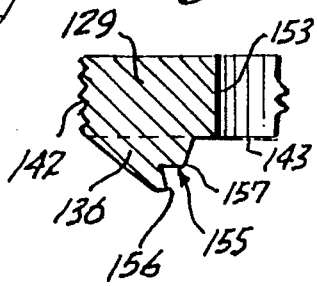
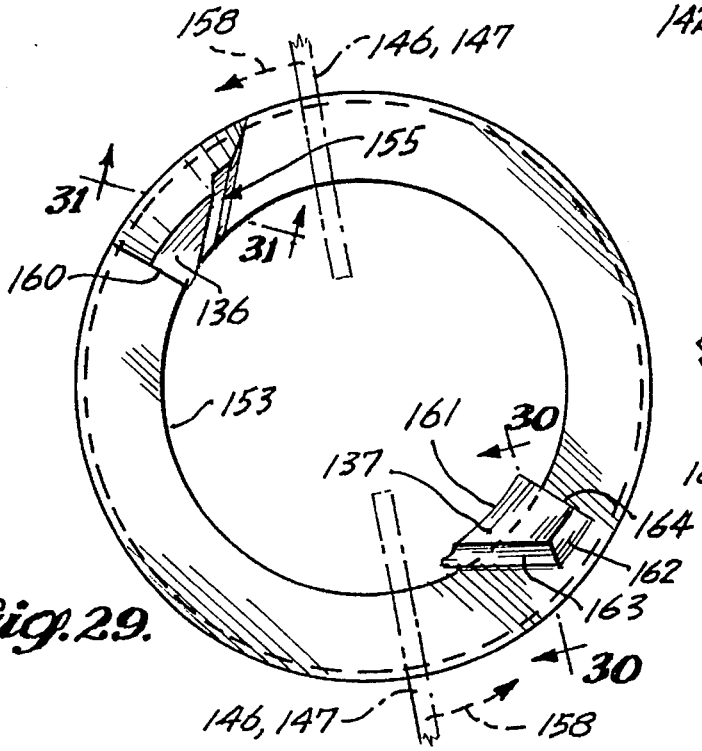
Fig. 29.
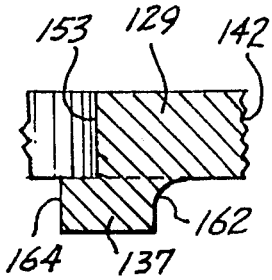
Fig. 30.

CENTRIFUGAL CHOPPER PUMP WITH INTERNAL CUTTER

CROSS REFERENCE

This application is a continuation-in-part of application Ser. No. 08/132,117, titled "Multistage Centrifugal Chopper Pump," which was filed on Oct. 5, 1993, and which was a continuation-in-part of application Ser. No. 07/889,519, titled "Centrifugal Chopper Pump," which was filed on May 26, 1992, now U.S. Pat. No. 5,256,032, issued Oct. 29, 1993. Both of said earlier applications are expressly incorporated by reference herein.

FIELD OF THE INVENTION

The present invention relates to a centrifugal pump effective for pumping liquids and slurries containing solid matter, including various types of refuse, and for chopping the solid matter which may thereafter be processed for disposal.

BACKGROUND OF THE INVENTION

Vaughan U.S. Pat. No. 3,155,046, issued Nov. 3, 1964, discloses a centrifugal pump having an open impeller with radial vanes. The vane edges adjacent to the pump inlet cooperate with sharpened edges of inlet apertures to cut stringy material or chunks entering the pump. Similarly, Vaughan U.S. Pat. No. 3,973,866, issued Aug. 10, 1976, and Dorsch U.S. Pat. No. 4,842,479, issued Jun. 27, 1989, disclose centrifugal pumps having impellers with vanes cooperating with inlet apertures to achieve a chopping or slicing action of solid material in a liquid or slurry being pumped. In the case of the pumps of Vaughan U.S. Pat. No. 3,973,866 and Dorsch U.S. Pat. No. 4,842,479, however, semi-open impellers having radial shroud plates are used; and external booster propellers are provided to accelerate flow into the pump, to displace chunks of solid matter which become lodged in the inlet apertures and, at least in some instances, to cut solid matter prior to entry into the pump.

Other types of pumps having external cutters rotated with an impeller or propeller are shown in Farrand U.S. Pat. No. 2,714,354, issued Aug. 2, 1955; Peterson U.S. Pat. No. 3,325,107, issued Jun. 13, 1967; and French Patent No. 1.323.707, issued Mar. 1, 1962.

Sutton U.S. Pat. No. 3,444,818, issued May 20, 1969, discloses another type of centrifugal pump having an internal impeller with vanes cooperating with the periphery of an inlet aperture to achieve a slicing action. In the Sutton construction, an outer "chopper member" has blades that wipe across the outer surface of the apertured intake plate to assist in chopping solid material to a size small enough to enter the intake aperture. Similarly, in the construction shown in British Patent No. 1,551,918, published Sep. 5, 1979, external blades sweep across small intake apertures to dislodge or gradually cut solid material clogging an intake aperture. In both the construction shown in the Sutton patent and the construction shown in the British patent, the external member is mounted so as to be moveable axially away from the intake plate if a hard obstruction is encountered.

Other types of pumps designed for pumping liquids or slurries containing solid materials are disclosed in Canadian Patent No. 729,917, issued Mar. 15, 1966; Schlesiger U.S. Pat. No. 3,340,812, issued Sep. 12, 1967; Elliott U.S. Pat. No. 4,527,947, issued Jul. 9, 1985; and Corkill U.S. Pat. No. 4,575,308, issued Mar. 11, 1986.

SUMMARY OF THE INVENTION

The principal object of the present invention is to provide a durable centrifugal pump effective for pumping liquids and slurries containing a large variety of solid refuse, including tough, resilient materials resistive to being cut, and strong, stringy, fibrous or sinewy materials which may have a tendency to wind around and clog or impede rotating components in addition to being resistive to being cut.

In one embodiment of the present invention, the foregoing object is accomplished by providing a centrifugal pump having several cutting, slicing and/or chopping stages, preferably both inside and outside the bowl in which the impeller rotates. The pump can have an open impeller with vanes having cutting edges at both the intake side of the pump bowl and along the closed side of the bowl. At the intake side, the adjacent vane edges cooperate with intake apertures for a slicing or chopping action similar to some of the devices described above. However, the chopping effectiveness at the intake side is increased by providing at least one narrow internal anvil rib extending generally radially outward from the intake apertures to the circle defined by the free ends of the rotating impeller vanes. The radially outer portions of the impeller vanes are notched so as to pass closely over the anvil rib to achieve an internal cutting action at the intake side of the pump.

In addition, narrow anvil ribs are provided at the closed side of the pump bowl, opposite the intake side, for close cutting cooperation with the edges of the impeller vanes remote from the intake apertures. Therefore, solid matter is sliced and chopped as it enters the intake apertures, and also is sliced and chopped inside the bowl at both the intake side and the closed side during rotation of the internal impeller.

Further, the intake end plate of the pump has an outer depression or recess with the intake apertures being formed in the base of the recess. Raised anvil ribs extend across the base of the recess and in an axial direction along the peripheral portion of the recess. An external cutter rotated with the internal impeller has chopper blades which cooperate with such external anvil ribs for an exterior chopping action of matter which otherwise might become lodged in or adjacent to the intake apertures. The hub of the cutter can have sharp teeth effective to chew through tough, resilient or sinewy material and prevent such material from winding around the cutter. An intake manifold adjacent to the pump inlet can have restrictor bars extending radially inward over the axially extending peripheral anvil ribs to trap solid material and prevent it from escaping outward without being cut or chopped into smaller pieces.

In another embodiment, two or more external cutters are provided, separated by an anvil plate which can have holes limiting the maximum diameter of solid material entering the pump bowl. The innermost cutter has radial blades with one sharpened cutting edge adjacent to the intake plate leading into the pump bowl and another sharpened cutting edge adjacent to the anvil plate which is spaced outward from the pump intake. Such innermost cutter also can have sharpened ends cooperating with anvil ribs located along the peripheral portion of the recess between the pump intake and the anvil plate. An additional external cutter with sharpened edges rotates in a recess located outward of the apertured anvil plate, and still another external chopper member is spaced outward from the second cutter. Thus, material passing into the pump must flow through a plurality of cutting, slicing and/or chopping stages before reaching the impeller.

In another embodiment, stationary cutters are provided adjacent to the impeller hub at the opposite sides of the pump bowl from its inlet. Such cutters cooperate with the radially inner edges of vanes of the impeller to prevent tough material from collecting adjacent to the hub, particularly in the area of the seal.

BRIEF DESCRIPTION OF THE DRAWINGS

FIG. 5 is a section taken along line 5—5 of FIG. 2 (looking toward the pump intake) with parts deleted; and FIG. 6 is a section taken along line 6—6 of FIG. 5 with parts deleted.

FIG. 7 is a section taken along line 7—7 of FIG. 2 (looking away from the pump intake) with parts deleted and parts broken away; and FIG. 8 is a section taken along line 8—8 of FIG. 7.

FIG. 9 is an intake end elevation of the pump of FIG. 2, viewed from line 9—9 of FIG. 2, illustrating the external cutter of such pump; FIG. 10 is a side elevation of such cutter removed from the pump; and FIG. 11 is a section of such cutter taken along line 11—11 of FIG. 10.

FIG. 25 is an enlarged bottom perspective of the cutter ring of the pump of FIG. 22; FIG. 26 is a section taken along line 26—26 of FIG. 25; and FIG. 27 is a section taken along line 27—27 of FIG. 25.

FIG. 28 is a bottom perspective of the cutter ring of the pump of FIG. 22, corresponding to FIG. 25 but with the cutter ring rotated 180°.

FIG. 29 is a bottom plan of the cutter ring of the pump of FIG. 22; FIG. 30 is a section taken along line 30—30 of FIG. 29; and FIG. 31 is a section taken along line 31—31 of FIG. 29.

DETAILED DESCRIPTION OF THE PREFERRED EMBODIMENT

Figure 1:
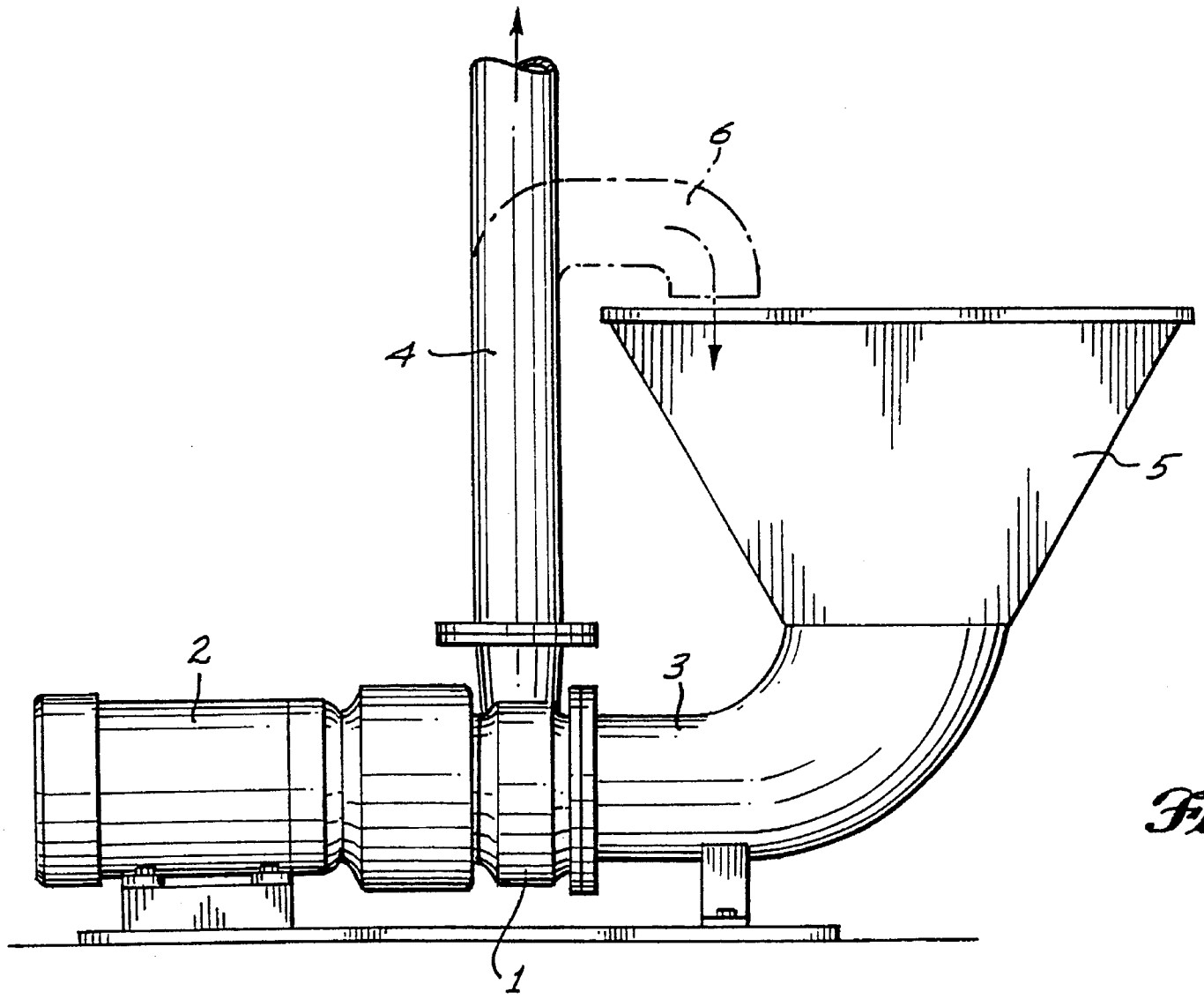
FIG. 1 is a side elevation of an installation of a multistage centrifugal chopper pump in accordance with the present invention.

FIG. 1 illustrates one representative installation of a centrifugal chopper pump 1 in accordance with the present invention. Pump 1 has an internal impeller rotated about a horizontal axis by an appropriate motor 2 so as to draw matter axially into the pump through an intake pipe or manifold 3. Such matter is discharged generally tangentially of the impeller through an outlet pipe 4. Intake pipe 3 extends to a hopper 5 for receiving refuse to be chopped and pumped. The hopper is kept filled or partially filled with water to assist in the pumping action. The mixture of water and chopped refuse can be recirculated back through the pump by way of a return pipe 6 illustrated in broken lines in FIG. 1 until such time as the refuse has been chopped sufficiently for further processing or disposal.

It is important that the pump in accordance with the present invention be capable of pumping and chopping a wide variety of materials. For example, there has been concern over processing and disposal of medical waste which often is not sorted but which is simply collected in plastic garbage bags. Processing of the medical waste may be easier if the diverse materials could be pumped to a processing location or processing equipment, particularly if the materials were chopped efficiently. Representative of such materials are: bandages and dressings which may contain adhesives so as to stick and collect on surfaces with which they come in contact; synthetic rubber gloves or other items of resilient but tough materials resistant to puncturing and cutting; various types of sinewy nettings and gauzes, including stretch hosiery and fabrics which, if not cut or chewed effectively, tend to wind around and bind or impede rotating components; and various throwaway plastic items, including the sheet plastic garbage bags themselves. Bags of such materials can be loaded into the hopper 5 and the pump 1 in accordance with the present invention is effective to chop the solid matter into small pieces and discharge the mixture of solid matter and water through the outlet pipe 4.

Figure 2:
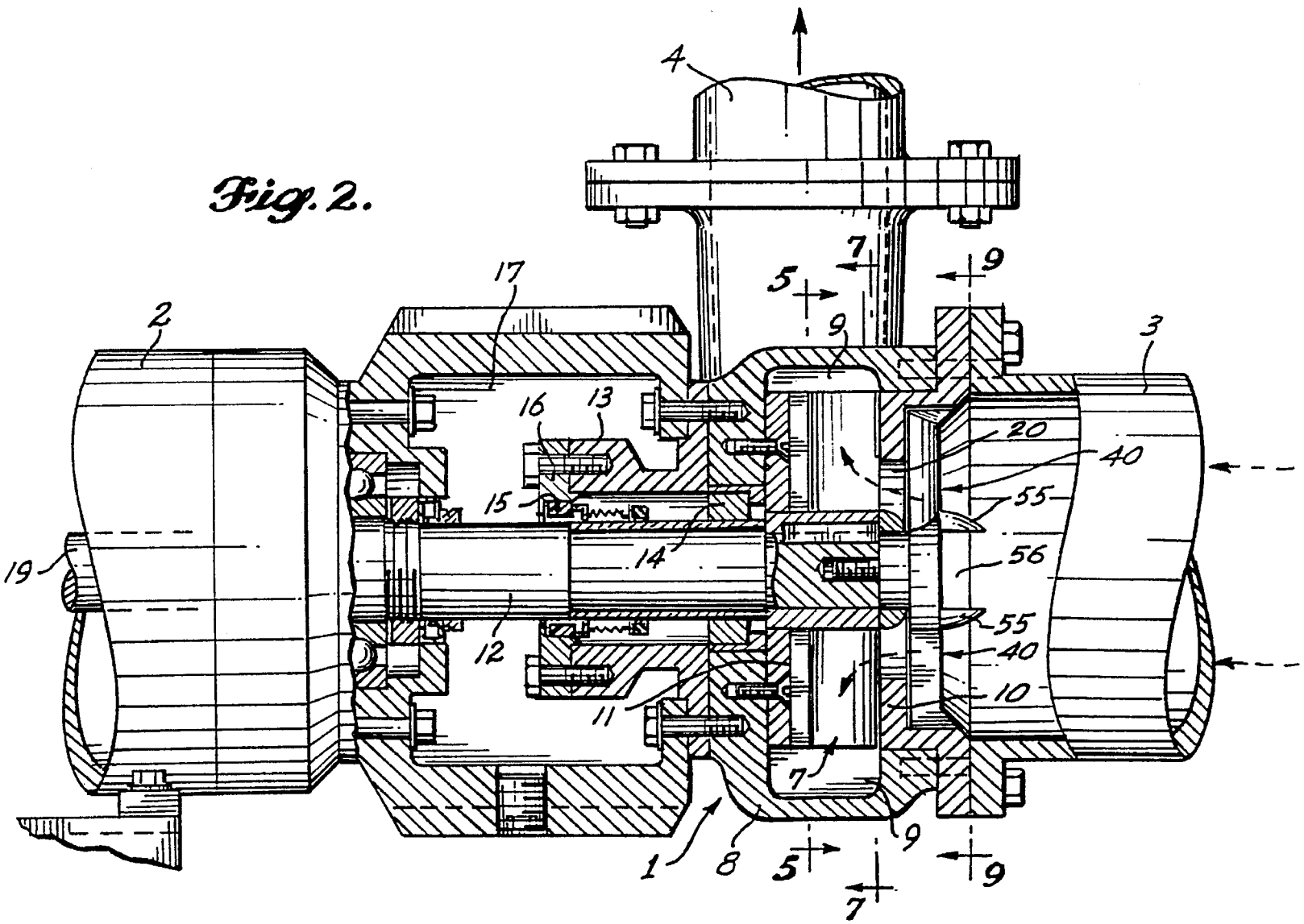
FIG. 2 is an enlarged side elevation of a multistage centrifugal chopper pump in accordance with the present invention with parts broken away to reveal the interior of the pump bowl and adjacent structure.

The internal construction of a first embodiment of pump 1 in accordance with the present invention is shown in FIG. 2 along with adjacent components of the representative installation. The internal pump impeller 7 rotates in a generally cylindrical casing 8 defining a volute bowl 9 having an open side partially closed by an intake plate 10. Bowl 9 has a closed side 11 through which the impeller drive shaft 12 extends. Shaft 12 extends from the impeller through a stuffing box 13 of conventional design including a bushing 14 at one end, in which the drive shaft is journaled adjacent to the closed side of the pump bowl, and a mechanical seal 15 and gland ring 16 at the other end of the stuffing box. The stuffing box is enclosed in a packing housing 17. Outside the stuffing box, the impeller shaft 12 extends through conventional bearings 18 and is coupled to or integral with the motor output Shaft 19. Rotation of the impeller 7 by its drive shaft 12 induces material to be sucked axially inward through intake apertures 20 of end plate 10. Such material is slung outward to the periphery of and circumferentially of the bowl 9 until it is discharged through the outlet pipe 4.

Figure 3:
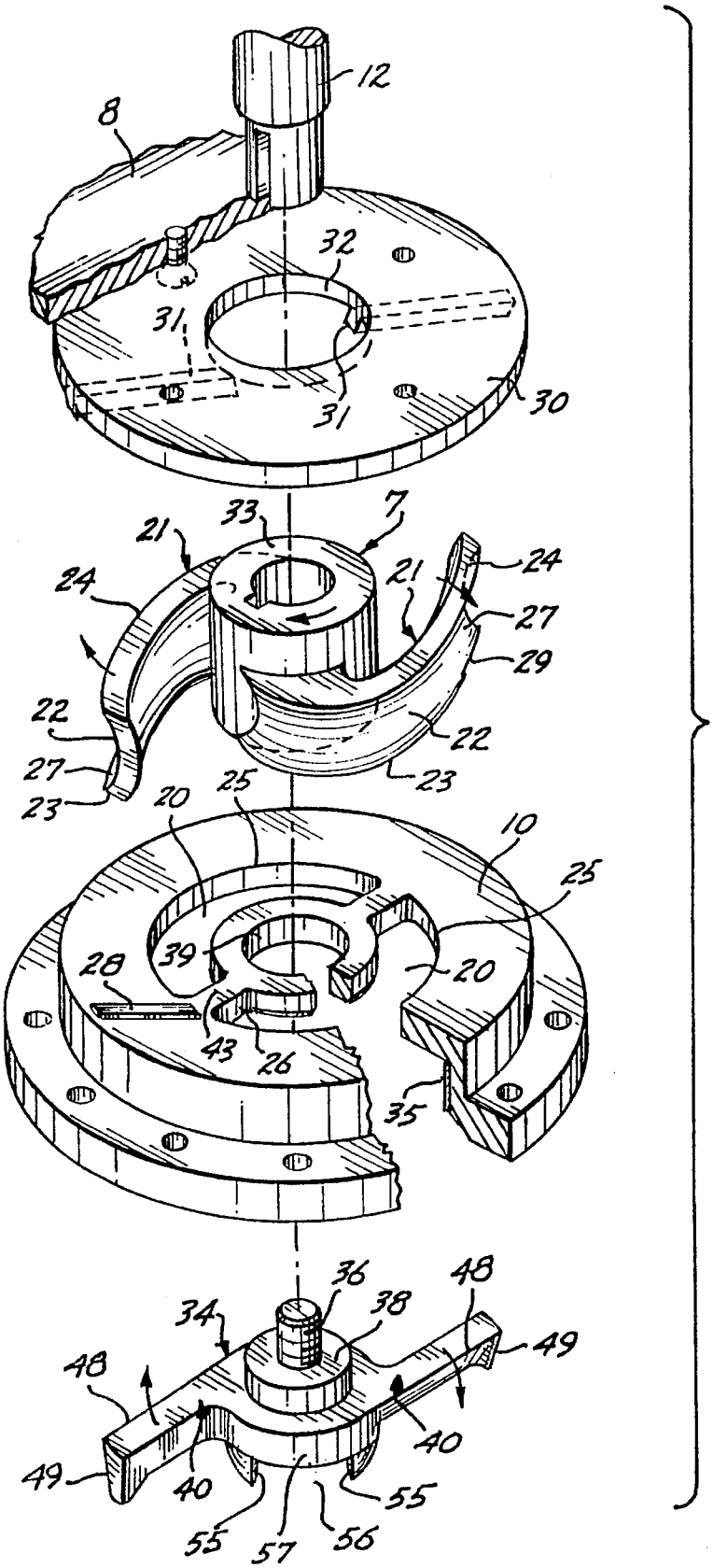
FIG. 3 is a fragmentary perspective of components of the pump of FIG. 2 taken from the closed side of the pump bowl, with parts shown in exploded relationship.
Figure 4:
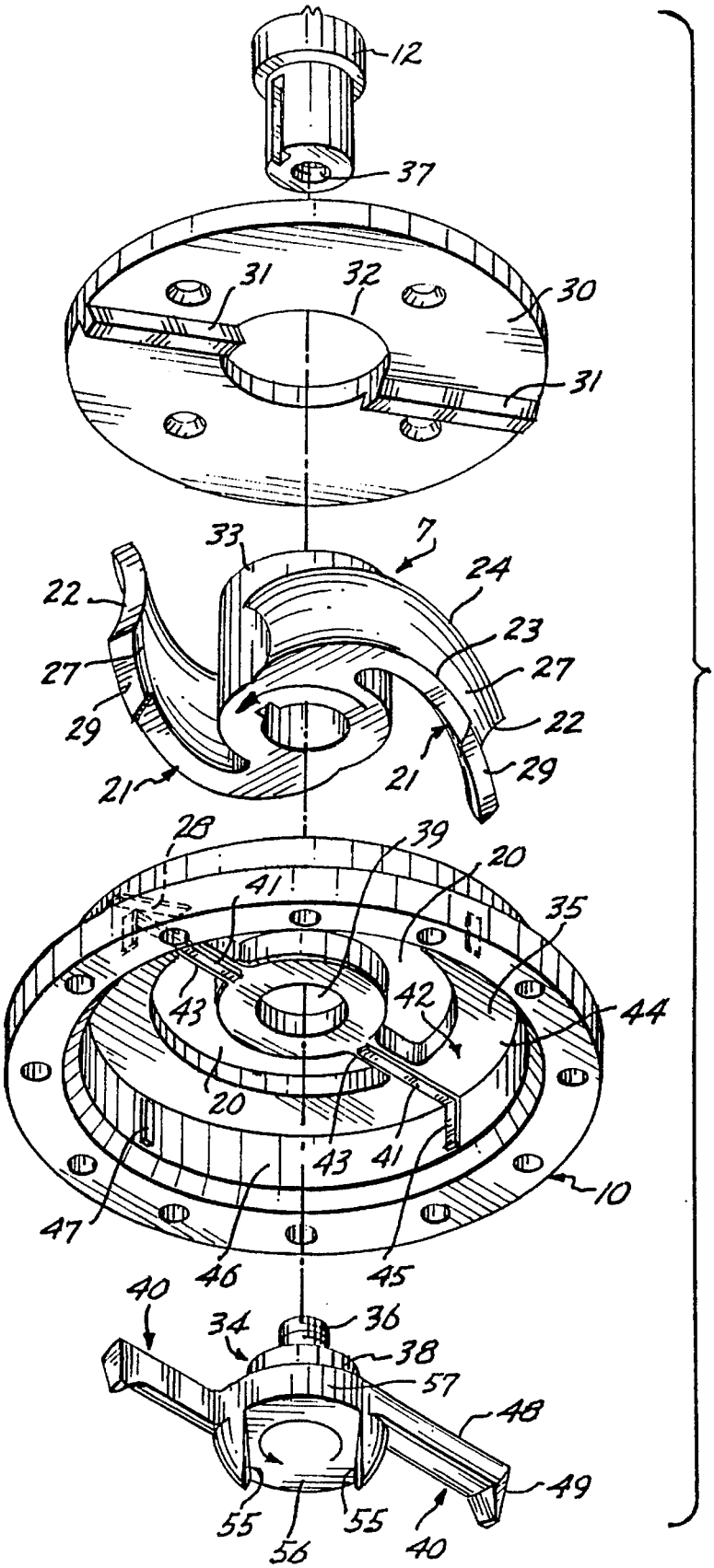
FIG. 4 is a corresponding perspective of such components but taken from the intake side of the pump.

The cooperating chopping components of the pump in accordance with the present invention are best seen in FIGS. 3 and 4. For internal chopping of solid matter in the liquid being pumped, the impeller 7 is of open design having two or more pumping vanes or blades 21 spiraled rearward relative to the direction of rotation of the impeller. Each blade is of substantially constant width, measured in a direction parallel to the axis of rotation, from its root to its outer tip and has a cupped leading face 22 such that both the intake edge 23 and opposite edge 24 of each blade are sharpened. The sharpened intake edge 23 of each impeller blade cooperates with the circumferential sides 25 and forward sides 26 of the arcuate intake apertures 20 for a slicing and cutting action of the type achieved in the pump of U.S. Pat. No. 4,842,479, for example. In addition, the free end portion 27 of each blade extends outward beyond the outer sides 25 of the intake apertures. In this radially outer zone, the inside surface of the intake plate 10 is provided with a short anvil rib 28 which projects from the otherwise planar inner surface of the intake plate exposed to the pump bowl. Such rib 28 is linear but does not extend precisely radially. From the inner end of the rib, the rib extends outward and forward relative to the direction of rotation of the impeller such that a blade tip portion slices gradually over the length of the rib as seen in FIG. 5. The tendency is to urge solid matter outward and circumferentially of the bowl toward the outlet as the material is sliced. Each blade has an end notch 29 so that the inner portion of the intake edge of the blade is in close cutting relationship to the inlet apertures while the outer portion passes closely along and over the anvil rib 28.

At the closed side of the pump bowl, a chopper plate or disk 30 is provided with at least one, preferably two, inward-projecting anvil ribs 31 best seen in FIG. 4. Disk 30 can be fastened to the closed side of the pump casing or ribs 31 can be cast or machined into the casing. Such ribs extend linearly outward from the central bore 32 which closely receives the hub 33. Preferably, ribs 31 extend almost radially such that the cutting edges 24 of the impeller blades which are swept rearward in the direction of impeller rotation pass closely across the ribs gradually from the radially inner portion of each blade toward its radially outer portion, as seen in FIG. 7, for an outward-directed slicing action at the closed side of the pump bowl. Again, the tendency is to force solid matter outward and circumferentially for passage to the pump outlet.

In addition to the cutting action achieved by cooperation of the intake edges 23 of the impeller with the sides of the intake apertures 20, the slicing action achieved inside the pump bowl by the notched tip portions 27 of the blades in combination with the abrupt intake surface anvil rib 28, and the slicing action achieved at the closed side of the bowl by cooperation of the sharpened edges 24 of the impeller blades with the abrupt anvil ribs 31, preferably the pump in accordance with the present invention also has at least one external cutter-chopper 34 coupled to and rotated with the impeller. In the embodiment illustrated in FIGS. 2 through 11, the intake plate 10 has a cylindrical outward-opening depression or recess 35 in which the external cutter 34 rotates. Such cutter can have an externally threaded stud 36 for reception in an internally threaded end bore 37 of the impeller drive shaft 12 and a circular stepped hub 38 journaled in the central aperture 39 of the intake end plate 10. Cutter 34 has two blades 40 extending oppositely from the hub. Narrow anvil ribs 41 extend radially outward and project axially from the otherwise planar outer face 42 of the base of the end plate recess 35. Such ribs include inner portions extending across the joining sections 43 between the arcuate intake apertures 20 and outer portions extending across the unapertured annular portion 44 of the end plate surrounding the apertures. Such outer portions of the base ribs 41 lead to side ribs 45 extending axially along the peripheral wall 46 of the end plate depression and projecting abruptly radially inward. Preferably, additional side ribs 47 are spaced along such wall.

The external cutter blades 40 include linear sharpened leading edges 48 in close cutting relationship to the base ribs 41 as the cutter is rotated. In addition, each blade has an outturned tip or fin 49 extending generally perpendicularly from the radial portion of the blade and sharpened for cutting cooperation with the anvil ribs 45 and 47 spaced around the circumference of the end plate recess. As seen in FIG. 11, preferably the generally radially extending portions of the blades 40 taper in circumferential thickness from their edges 50 adjacent to the end plate to their edges 51 spaced outward therefrom. As seen in FIG. 10, the fins 49 taper in thickness from their base or root portions to their outer tips 52 and have inner surfaces 53 beveled inward and rearward relative to the direction of cutter rotation. The angled leading faces 54 of the external cutter blades and the beveled surfaces 53 of the fins help to clear material from the pump intake if such material does not readily pass into the pump through the apertures 20.

The external cutter 34 also includes an outer circular hub 57 of a diameter approximately equal to the inner diameter of the arcuate intake apertures 20. During manufacture, such hub is approximately hemispherical, but two axially extending teeth 55 are formed by cutting a wide groove 56 through the hub at an angle of approximately 45° relative to the direction of projection of each of the external cutter blades 40. The resulting teeth have sharp arcuate cutting edges that grind and chew through tough materials, particularly sinewy materials, and prevent such materials from winding around the external cutter and thereby blocking the intake apertures and/or impeding rotation of the cutter or the impeller.

The combined effect is to chew and grind solid matter by the external teeth 55, chop and slice such matter externally of the pump casing by the cutter 34 in cooperation with the base and side ribs 41, 45 and 47, and continue to slice and chop such matter inside the pump at both the intake side and the closed side of the pump bowl.

Figure 13:
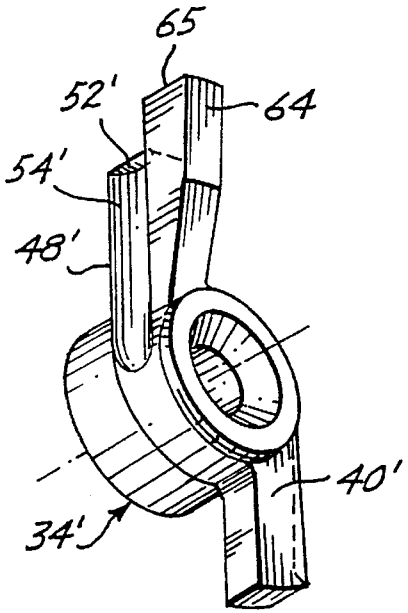
FIG. 13 is a perspective of the modified external cutter of FIG. 12 in a different rotated position.
Figure 12:
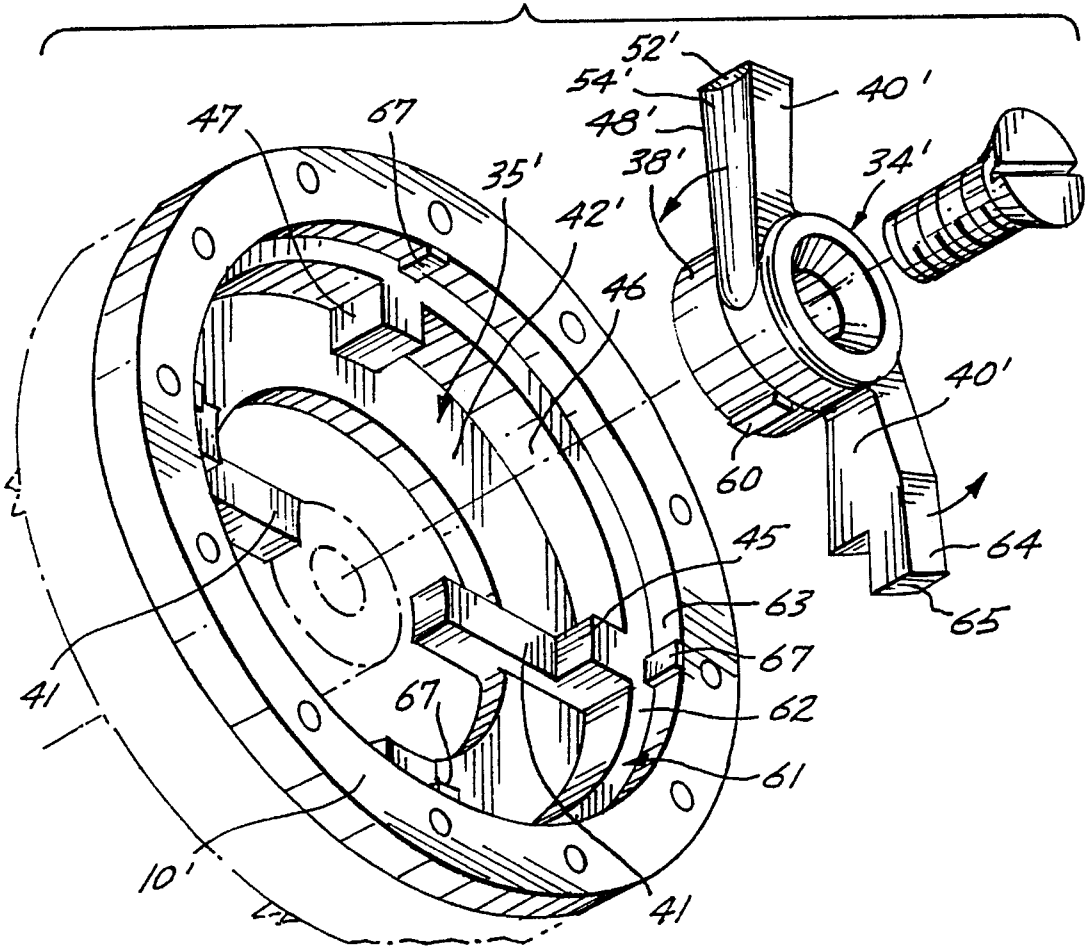
FIG. 12 is a perspective of components of a modified multistage centrifugal chopper pump in accordance with the present invention, namely, a modified intake plate and external cutter, with parts shown in exploded relationship.
Figure 15:
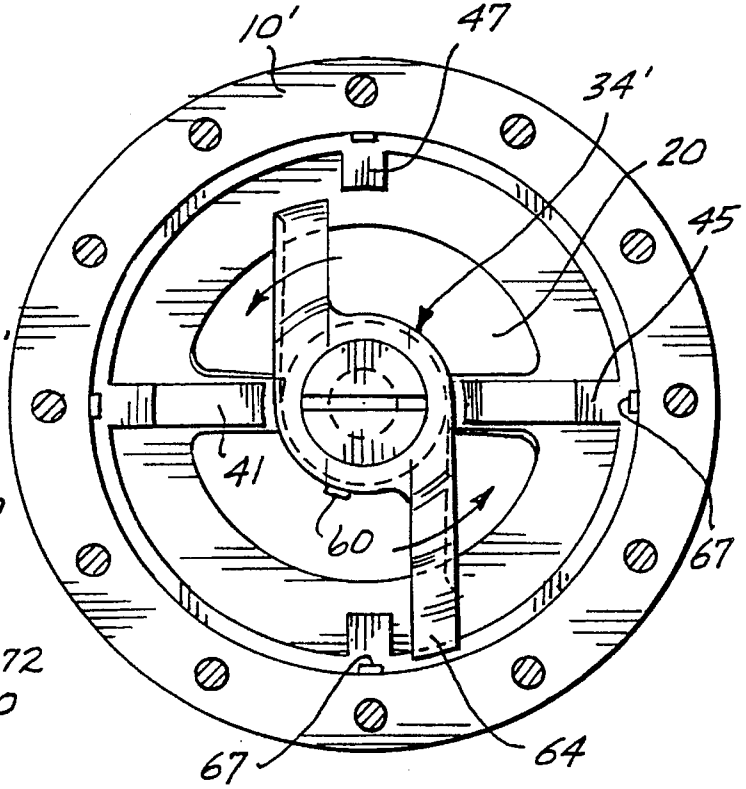
FIG. 15 is a section taken along line 15—15 of FIG. 14.

The modified external cutter-chopper 34' shown in FIGS. 12 and 13 has oppositely extending blades 40' for rotating in a modified end plate 10'. End plate 10' has a stepped outward-opening depression or recess, including an inner portion 35' having a base 42' which is planar except for the short, narrow, radially extending anvil ribs 41. As in the earlier described embodiment, ribs 41 lead to side ribs 45 which extend axially along the peripheral wall 46 of the inner recess portion 35'. Additional side ribs 47 are spaced midway between the opposing ribs 45.

The hub 38' of the modified external cutter 34' is of a diameter slightly less than the distance between the inner ends of the base anvil ribs 41. Such hub has an abrupt projection 60 extending in an axial direction for achieving a central chopping action as it passes the inner ends of ribs 41. The leading faces 54' of the wings 40' are concave to form the sharpened leading edges 48' and the sharpened tip portions 52' which cooperate with the ribs 41, 45 and 47 for an abrupt chopping action as the external cutter 34' rotates in the inner portion 35' of the end plate recess.

End plate 10' has an outer recess 61 of a diameter greater than the diameter of the inner recess portion 35'. Consequently, an annular shoulder 62 in a diametral plane is formed outward of the inner recess portion 35', terminating at a short peripheral wall 63. At least one of the blades 40' of cutter 34' has an outer finger 64 projecting beyond the inner portion of the blade fitted in the inner recess portion 35'. Finger 64 rotates in the larger outer recess 61. The outer end 65 of finger 64 passes close to additional short and narrow anvil ribs 67 projecting inward from the peripheral wall 63 for an additional stage of chopping as material passes into the pump.

Figure 14:
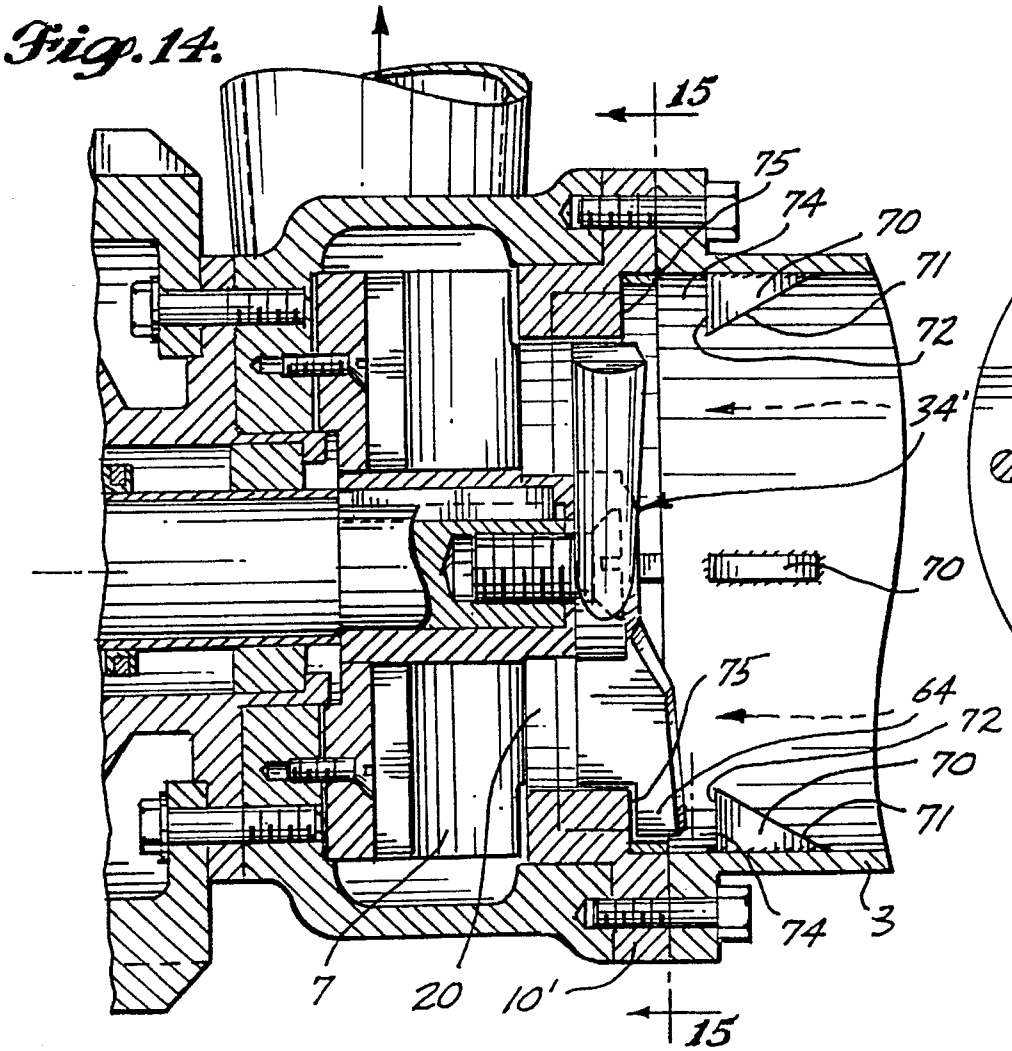
FIG. 14 is a side elevation of a multistage centrifugal chopper pump having the modified components of FIG. 12, with parts broken away to reveal the interior of the pump bowl and adjacent structure including a modified intake manifold.

For particularly hard synthetic plastic materials, which may be included in medical waste, there may be a tendency for the material to catch on a blade of an external cutter or be slapped away from the pump inlet. With reference to FIG. 14, the intake pipe or manifold 3 can have triangular flow restrictor bars 70 with angled faces 71 inclined toward the pump inlet and radial faces 72 spaced a short distance outward from the intake plate 10'. Hard, solid objects fed toward the external cutter 34' will be flung outward, if not chopped immediately, and are trapped in the wide grooves 74 formed between the inner faces 72 of the restrictor bars 70 and the outer annular surface 75 of the intake plate. The abrupt impact of the finger 64 of the external chopper 34' breaks or chops the hard object effectively, until it has been reduced in size sufficiently to pass farther inward where it is repeatedly chopped by the external cutter in cooperation with the pump intake apertures 20 and by the impeller 7 as the solid object passes into and through the pump.

Figure 16:
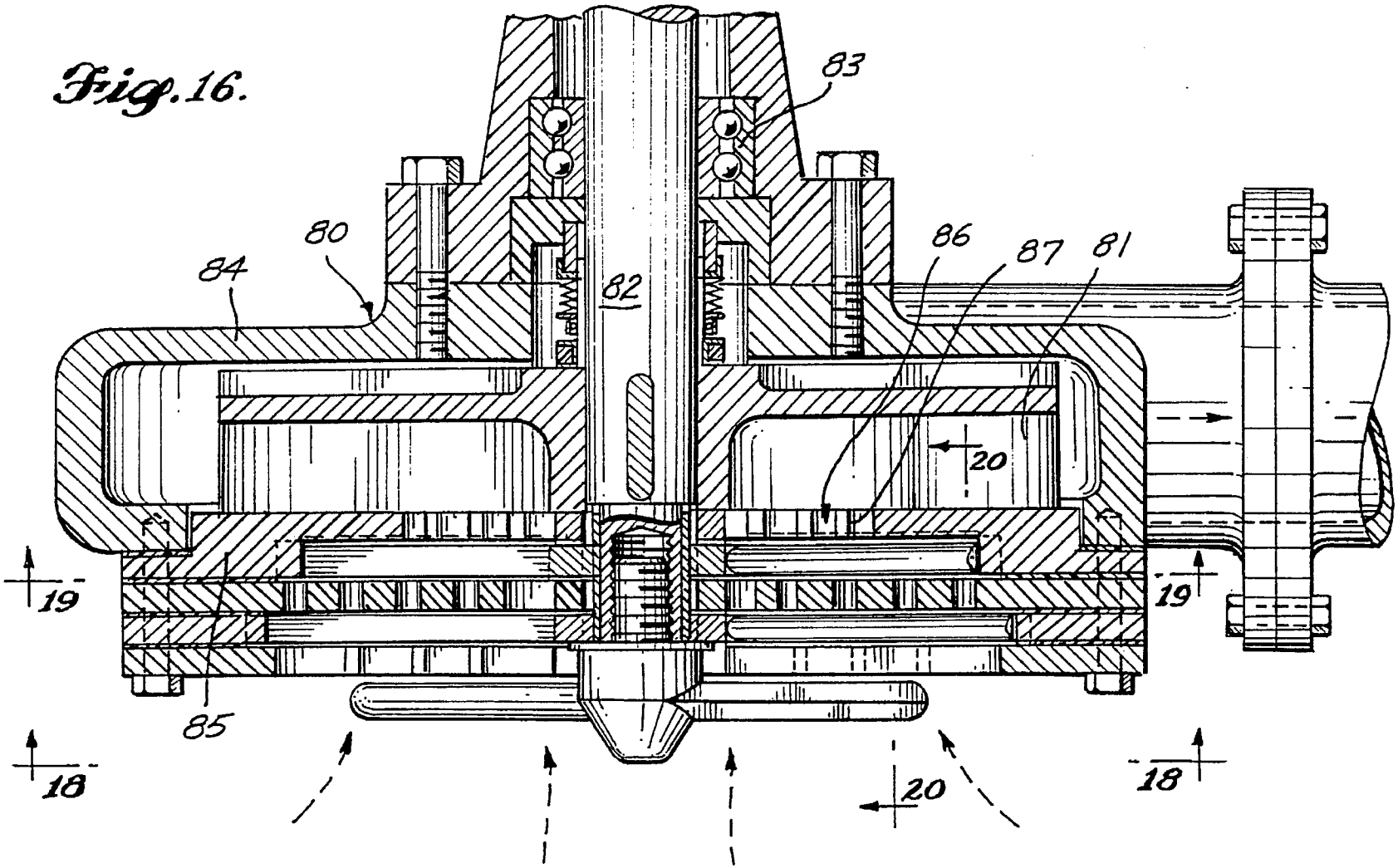
FIG. 16 is a side elevation of another embodiment of a multistage centrifugal chopper pump in accordance with the present invention, with parts broken away to reveal the interior of the pump bowl and adjacent structure.
Figure 17:
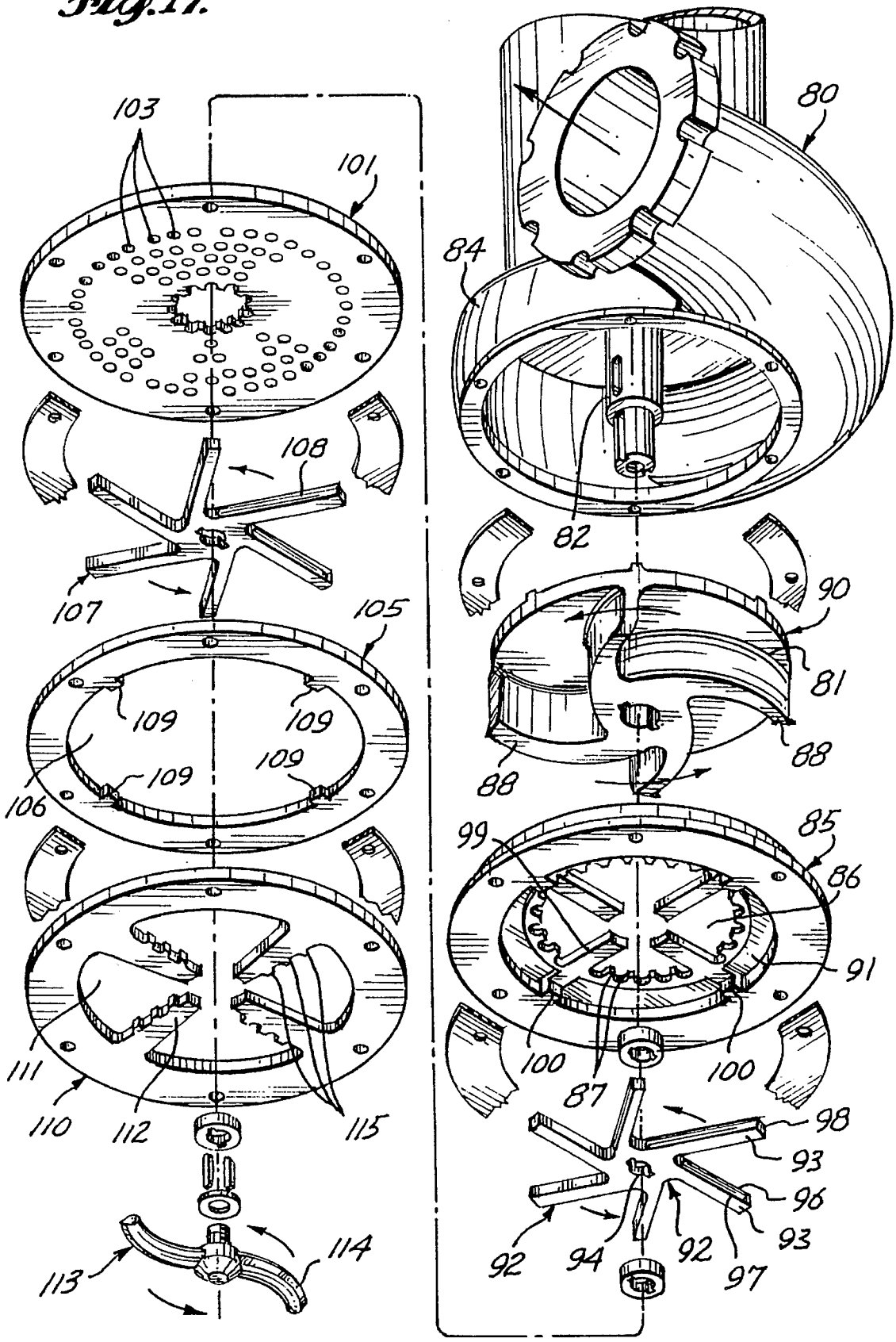
FIG. 17 is a perspective of components of the pump of FIG. 16 taken from the closed side of the pump bowl, with parts shown in exploded relationship.

Another embodiment of a multistage centrifugal chopper pump in accordance with the present invention is illustrated in FIGS. 16–21. With reference to FIGS. 16 and 17, similar to the previously described embodiments, pump 80 has an internal impeller 81 rotated by a drive shaft 82 journaled in bearings 83 at the closed side of the pump casing 84 which defines the bowl. The open side of the bowl is closed by an intake plate 85. Intake plate 85 has a central intake opening 86 with a scalloped peripheral edge 87 best seen in FIG. 17 which helps to catch and trap solid, particularly stringy, material entering into the pump for slicing or chopping by the impeller blades 88. Unlike the previously described embodiments, impeller 81 is of the semi-open type having a radial shroud plate 90 so that, internally of the pump bowl, the chopping action is achieved only at the outer edges of the blades 88 adjacent to the intake plate.

Figure 20:
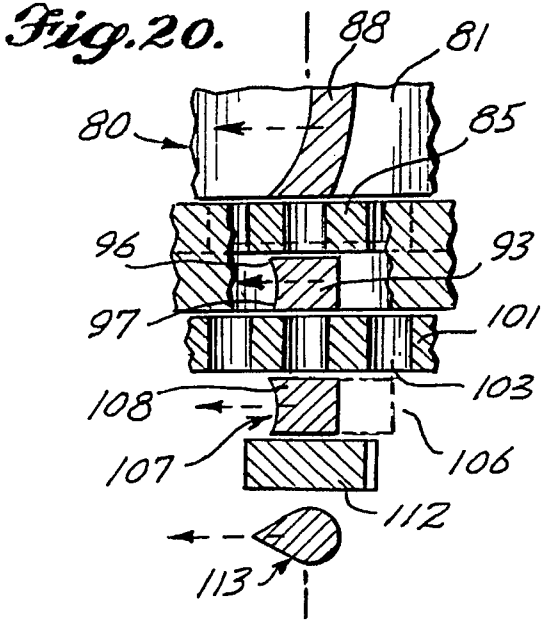
FIG. 20 is a somewhat diagrammatic fragmentary section taken along line 20—20 of FIG. 16.
Figure 21:
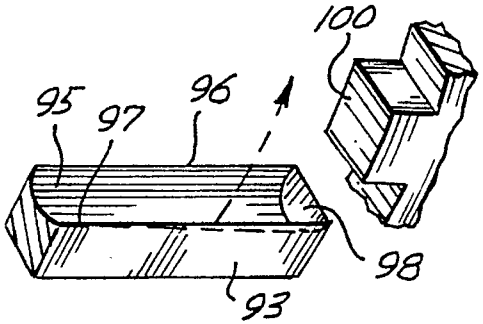
FIG. 21 is an enlarged, fragmentary, detail perspective of components of the pump of FIG. 16, namely, the radially outer end portion of an external cutter blade and a cooperating anvil rib.
Figure 19:
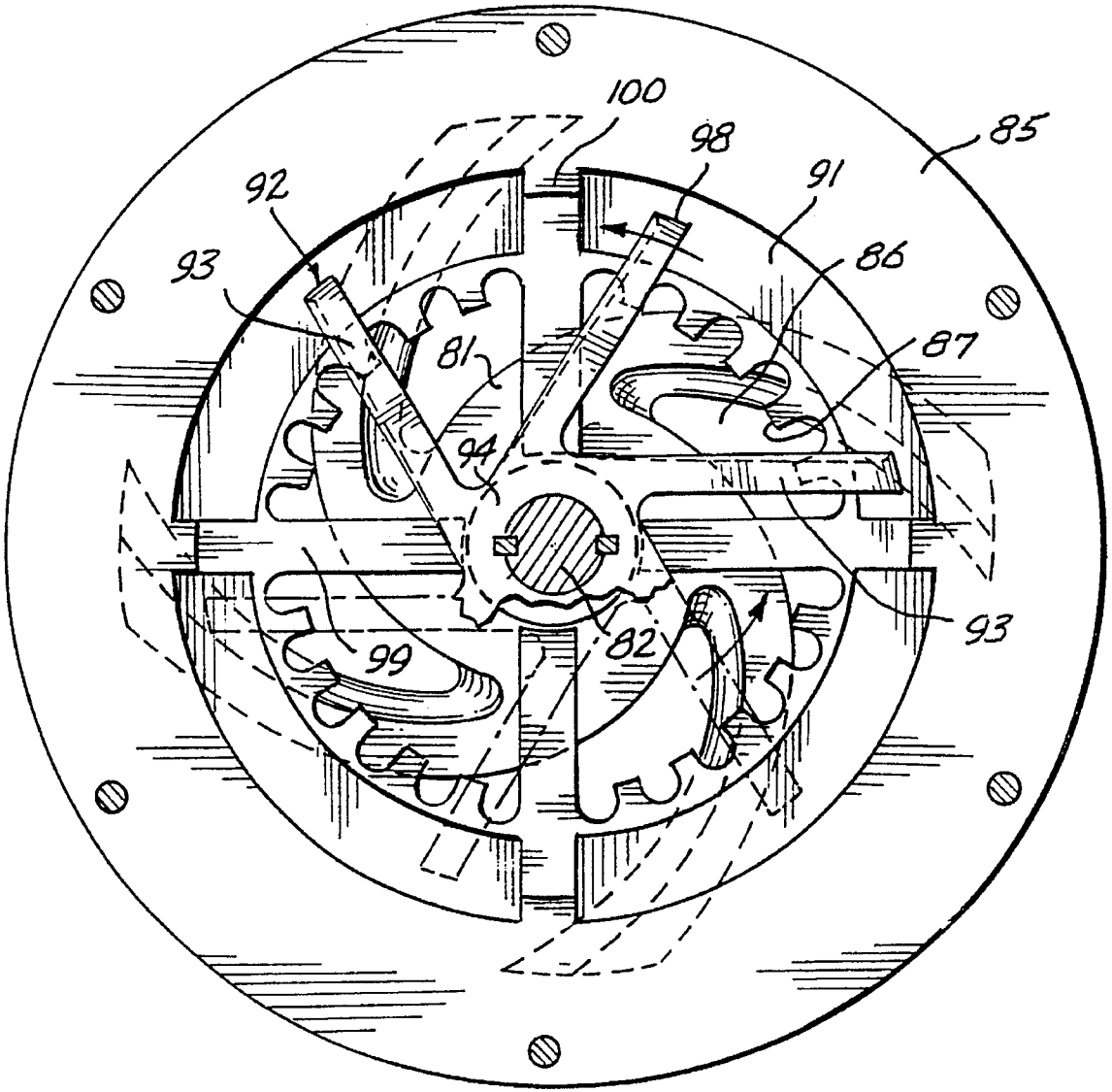
FIG. 19 is a section along line 19—19 of FIG. 16, with parts broken away.

With reference to FIG. 17, intake plate 85 has an outward opening recess 91 receiving an external cutter 92 which is rotated with the pump impeller. Cutter 92 has several blades 93 extending generally tangentially from the central hub 94. As best seen in FIGS. 20 and 21, blades 93 have concave leading edges 95 such that the long inner and outer edge portions 96 and 97 of the blades are sharpened, as well as the outer tip portions 98 (FIG. 17). The inner edges 96 are in close slicing or chopping contact with raised anvil ribs 99 (FIG. 17) of the intake plate 85, such ribs extending generally radially; whereas the sharpened blade tip portions 98 (FIG. 21) pass close to side anvil ribs 100 projecting inward from the peripheral wall of the intake plate recess.

An apertured plate 101 having a central hole for the drive shaft 82 extends across the intake plate recess 91 such that the external cutter 92 is fitted between the intake plate 85 and the apertured plate 101. The outer long sharpened edges 97 of the external cutter blades 93 pass close to the apertured plate for additional chopping and slicing of material entering the pump. The sizes of the holes 103 in the plate determine the maximum size of material allowed into the pump.

A spacer ring 105 of approximately the same axial thickness as the apertured plate 85 is centered over the apertured plate to define an additional outward opening recess 106 for a second external cutter 107. Cutter 107 can be of the same design as the first internal cutter 92 with its blades 108 being slightly longer to fit in the larger recess 106. The spacer plate 105 has short inward projecting anvil ribs 109 which cooperate with the sharpened ends of the blades 108 of the second external cutter 107. Also, the sharpened inner edges of the blades pass close to the outer face of the apertured plate 101 for chopping solid material as it enters the plate apertures. However, cutter 107 may be exposed to larger chunks of hard or tough material than the first internal cutter 92 which is located inside the apertured plate 101. Consequently, greater force may be applied to cutter 107 and it may be desirable to increase the width of blades 108, as shown in broken lines in FIG. 20. Also, if a wider blade is used, it may be necessary to use fewer than six blades on cutter 107, so as to reduce the area of the apertured plate 101 blocked by the cutter blades. If too large an area of the apertured plate is blocked, pump performance can be affected.

Yet another ring 110 is secured outside the spacer 105 forming the outside inlet openings 111 between inward projecting arms 112. The inner ends of such arms define an opening for the hub of a third external cutter 113 having blades 114 swept back relative to the direction of impeller rotation and having beveled top and bottom surfaces terminating at the sharpened leading edges spaced outward from plate 110. The arms 112 of the plate have teeth 115 along edges facing the oncoming blades for trapping and ripping solid material entering the pump. The long sharpened outer edges of the blades 108 of the second outermost external cutter 107 are in close cutting relationship to the inner sides of the arms 112.

Figure 18:
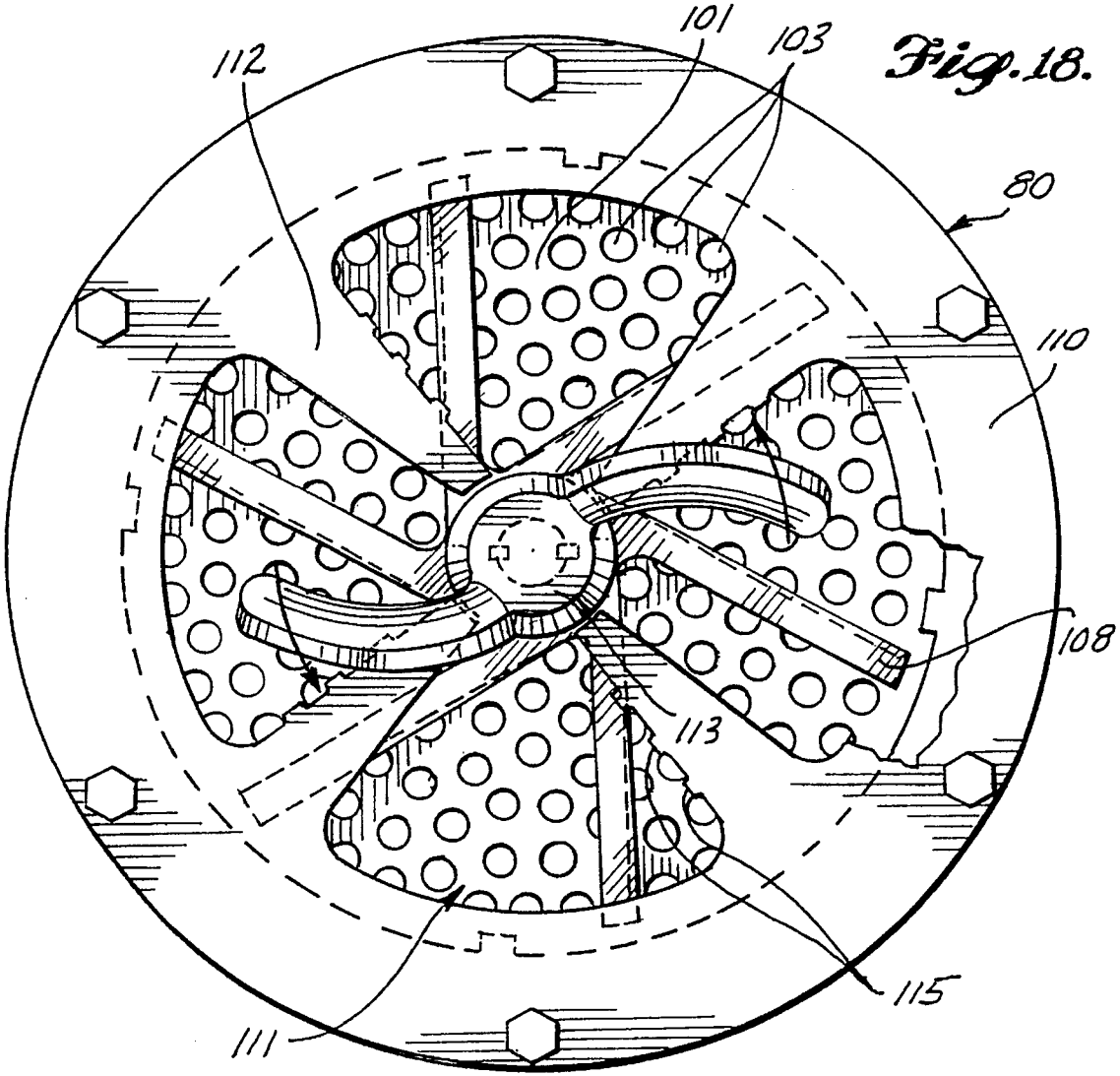
FIG. 18 is an intake end elevation of the pump of FIG. 16, viewed from line 18—18 of FIG. 16.

With reference to FIG. 18 and FIG. 20, material entering the pump 80 first is engaged by the outermost cutter 113 which deflects large solid material outward and slices and chops solid material as it enters between the inward extending arms 112. The teeth 115 on arms 111 help to trap the material so that it will be cut by the outermost cutter in addition to being sliced and chopped by the blades of the next innermost cutter 107. Only material of a diameter less than the diameter of the holes 103 of the apertured plate 101 will pass to the next stage of the pump for additional slicing and chopping action by the blades 93 of the first external cutter 92 in cooperation with the inner side of the apertured plate 101 and the outer side of the intake plate 85. Finally, the outer sharpened edges of the impeller blades 88 achieve a final slicing and chopping of solid material passing into the pump.

The semi-open impeller design of the embodiment of the present invention illustrated in FIGS. 16–21 generates substantially greater suction into the pump which, if desired, can be assisted by shaping the outermost cutter 113 as a booster propeller. Thus, any material tending to lodge in the apertured plate, for example, is sucked and pushed through to the final cutter stages. This design has been found to be particularly effective in the case of fish waste from canneries which may contain tough skin, cartilage, bone and soft tissue and organs of various sizes. At a cannery, it is important that the waste be chopped to a sufficiently small size that it will be carried away by tidal action for environmentally safe decomposition in the ocean, rather than collecting at a localized area close to the cannery where large amounts of the rotting waste are smelly and potentially environmentally dangerous.

Where there is harder and tougher material to be chopped, such as a variety of unprocessed medical waste, the embodiment of the invention shown in FIGS. 1–11 or 13–15 is preferred, although the open impeller design with chopping at both sides decreases the head and capacity of the pump.

Figure 22:
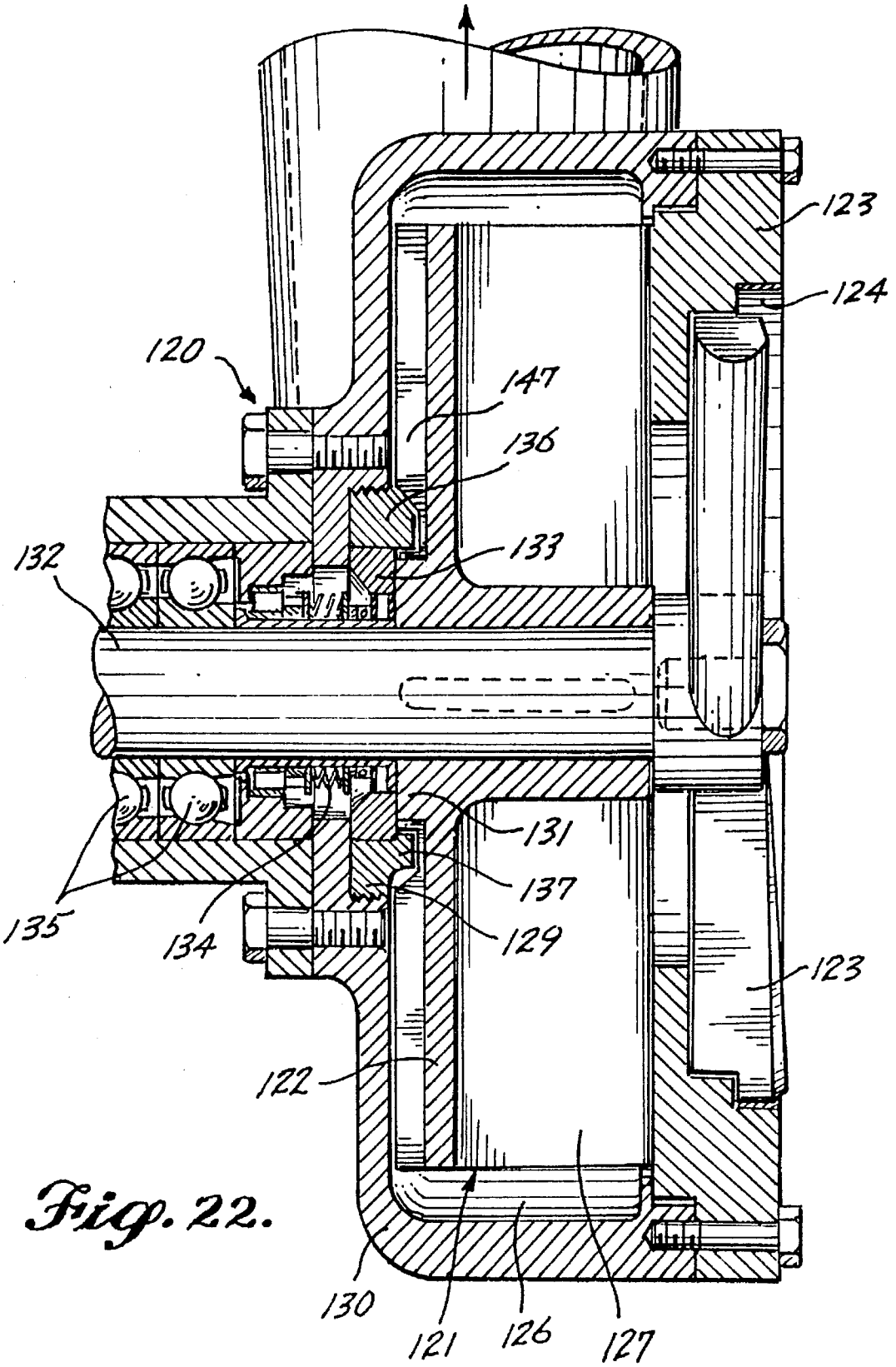
FIG. 22 is a side elevation of another modified centrifugal chopper pump in accordance with the present invention having stationary cutters adjacent to the hub of the pump impeller, with most parts shown in section.

The modified pump 120 shown in FIG. 22, and in more detail in FIGS. 23–33, uses a semi-open impeller 121 having a radial shroud plate 122, similar to the embodiment shown in FIG. 14. Also, the embodiment illustrated in FIG. 22 can use an external cutter-chopper 123 of the same general design as the cutter-chopper 34' described with reference to FIGS. 12 and 13. Such external cutter 123 rotates in a stepped recess 124 of an intake plate 125, such recess and intake plate being of the same general construction as described with reference to FIGS. 12–15. The slicing and chopping action for material entering through the intake plate is essentially the same as for the FIG. 12–15 embodiment.

However, in the embodiment of FIG. 22, a cutting mechanism is provided at the closed side of the pump bowl 126, i.e., the side opposite the intake plate 125 and at the opposite side of shroud plate 122 from the primary pumping vanes 127. In general, such additional chopping components include: raised vanes such as vanes 147 which preferably are formed integrally with the shroud plate 122 and are adjacent to the closed side of the pump bowl; and a cutter ring 129 which is threaded into an aperture in the closed side of the pump casing 130 adjacent to a hub portion 131 of the impeller. The impeller rotates with the impeller drive shaft 132, and a bushing 133 cooperates with the conventional mechanical seal 134 adjacent to the bearings 135 in which the drive shaft is journaled to protect the seal from material in the pump bowl 126. In general, the cutter ring with projecting teeth 136 and 137 is stationary relative to the pump casing and cooperates with the rotating vanes such as vanes 147 for slicing and chopping material that may work its way behind the shroud plate. Such material could otherwise wrap around the impeller hub in the area of the seal and thereby destroy or greatly lessen the effective life of the seal, and/or impede smooth rotation of the impeller by packing or binding between the shroud plate and the pump casing.

Figure 23:
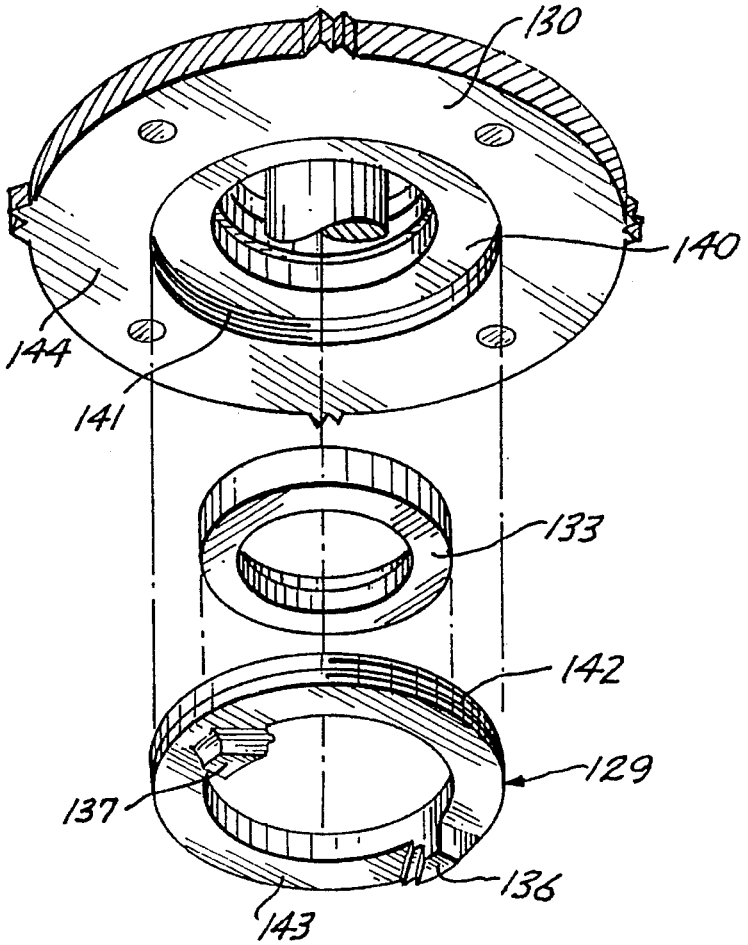
FIG. 23 is a fragmentary bottom perspective of the closed side of the pump bowl of the embodiment of the invention shown in FIG. 22, with parts shown in exploded relationship, namely, the cutter ring with internal cutters and the associated bushing, prior to installation of the cutter ring and bushing in the closed side of the pump bowl.

The general arrangement of the central portion of the pump casing 130, bushing 133, and cutter ring 129 is best seen in FIG. 23. A cylindrical recess or counterbore 140 is formed in the pump casing 130 and has internal threads 141 that mate with external threads 142 on the cutter ring. Bushing 133 is sandwiched between the base of the counterbore 140 and the cutter ring. The threaded interconnection of the cutter ring to the casing is greatly preferred over a screw or bolt interconnection because it provides support all the way around the periphery of the cutter ring and greatly reduces any tendency of the cutter ring to warp over time. The threaded connection also permits convenient disassembly of the unit, as compared to an interconnection using bolts which tend to wear over time when the material being pumped contains abrasives. When installed, the cutter ring 129 has a planar inner face 143 which preferably is substantially flush with the inner face 144 of the casing adjacent to the counterbore 140.

Figure 24:
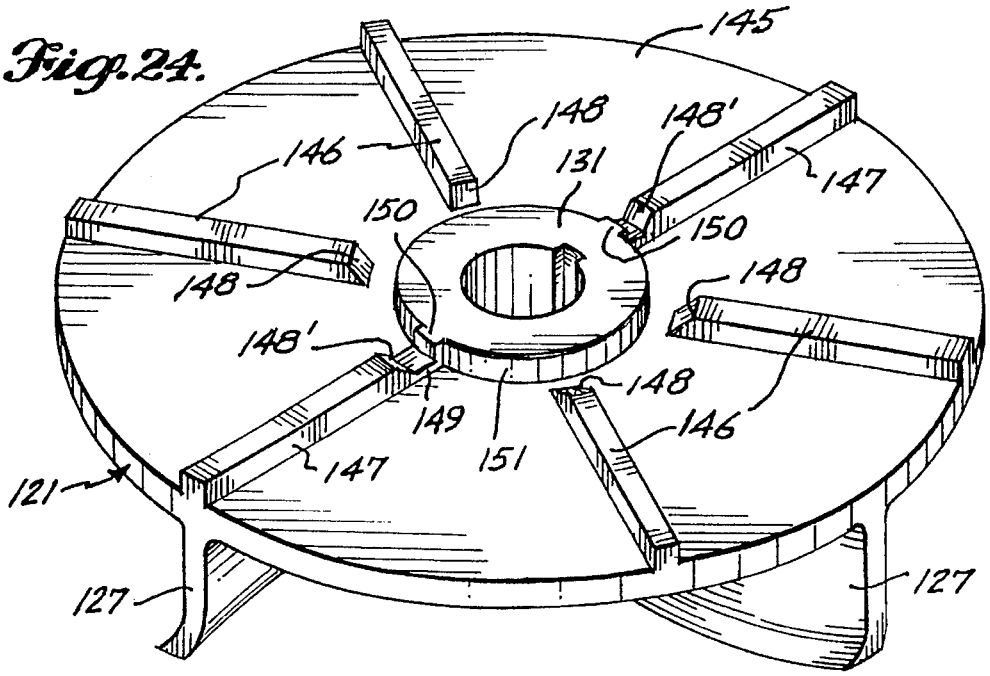
FIG. 24 is a top perspective of the impeller of the pump of FIG. 22, illustrating the cutter vanes disposed on the impeller shroud plate opposite the pumping vanes.

The stationary cutter teeth 136 and 137 of the cutter ring 129 project generally axially into the pump bowl toward the backside 145 of the impeller shroud plate shown in FIG. 24. In the illustrated embodiment, the impeller has six equiangularly spaced radial vanes 146 and 147. Vanes 146 have beveled ends 148 spaced slightly outward from the impeller hub 131, and each of such vanes 146 is diametrically aligned with an identical vane at the opposite side. Two vanes 147 also are diametrically aligned and have beveled portions 148' spaced outward from the impeller hub 131. However, vanes 147 also include short base portions 149 that extend radially inward from beveled portions 148' to narrow hub projections 150. Other than the narrow hub projections 150 of vanes 147, the impeller hub 131 has a cylindrical peripheral wall 151.

The stationary teeth 136 and 137 are of complicated shape, the details being illustrated in FIGS. 25–30. Tooth 136 has an inner axial surface 152 flush with the inner periphery 153 of the cutter ring 129. The opposite side of tooth 136, i.e., the radially outer side 154, is beveled at an angle equal to the bevel angle of the inner ends of the rotating cutter vanes (ends 148 and 148' seen in FIG. 24). Dealing next with the "leading" surface of tooth 136, which is the surface presented to oncoming rotating vanes 146, 147, tooth 136 has a serrated leading surface 155 as seen, for example, in FIG. 29 and FIG. 31, including two sharp corner edges 156 and 157. Corner edge 156 is formed at the tip of tooth 136 and corner edge 157 is closer to the inner face 143 of the cutter ring. As seen in FIG. 29, the leading surface 155 of tooth 136 does not extend radially, but rather is angled outward and rearward relative to the direction of rotation of the adjacent impeller, represented by the arrows 158. Finally, the "trailing" side 160 of tooth 136 extends essentially axially and radially, as seen in FIGS. 25 and 29.

Tooth 137 has an arcuate inner surface 161 which overhangs the periphery 153 of the cutter ring recess, i.e., tooth 137 is offset radially inward relative to tooth 136. Thus, surface 161 is disposed closer to the impeller hub than the inner surface 152 of tooth 136. The opposite surface 162 (the radially outer surface) is arcuate when viewed in a radial section such as FIG. 26. The leading face 163 of tooth 137 also is arcuate or cupped. The trailing face 164 is flat, extending generally radially of the ring.

Figure 33:
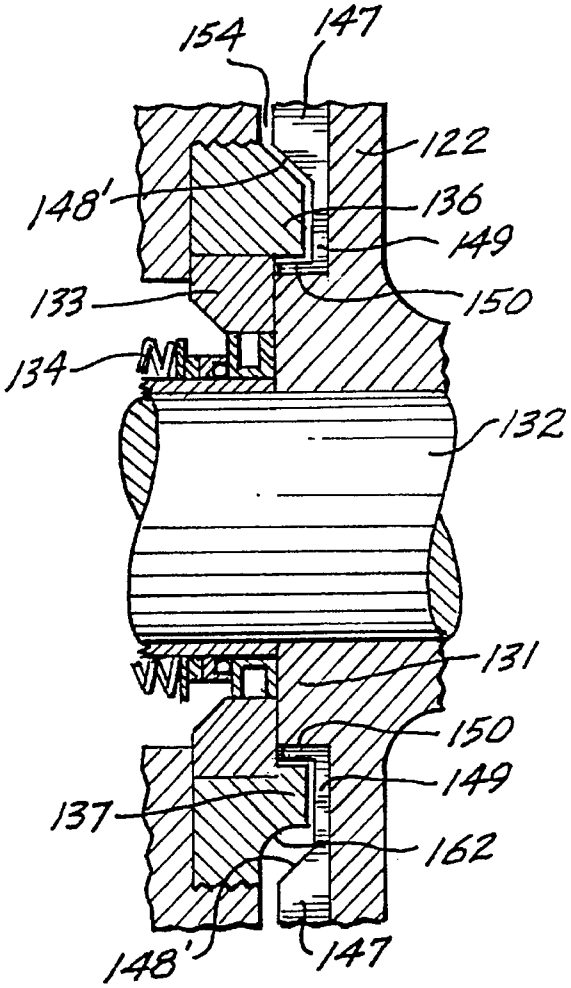
FIG. 33 is a corresponding enlarged fragmentary side elevation with the impeller in a different rotated position.
Figure 32:
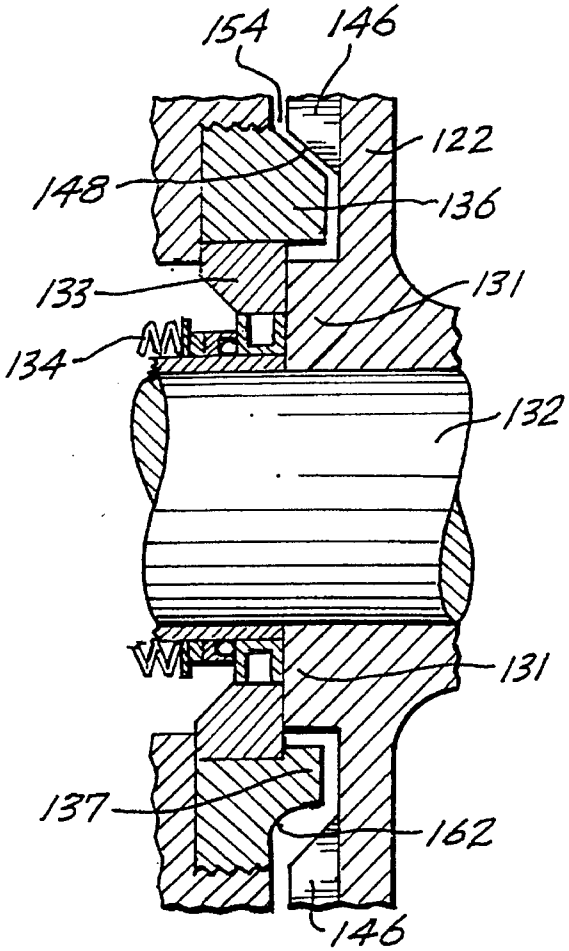
FIG. 32 is an enlarged fragmentary side elevation of the pump of FIG. 22 illustrating the cooperation of the internal cutting vanes of the impeller and the cutter ring, and with most parts shown in section.

The cutting action achieved by the rotating impeller vanes 146 and 147 and the stationary cutter teeth 136 and 137 is best described with respect to the enlarged sectional views of FIGS. 32 and 33. The types of materials that can work their way behind the shroud plate and wind around the impeller hub or drive shaft in the area of the seal also are typically the most sinewy and the toughest to cut. The combined action of the different types of cutting vanes 146 and 147 with the design of the different teeth 136 and 137 cuts and chops such materials quickly and effectively.

FIG. 32 illustrates the positions of the parts as the vanes 146 having the inner beveled ends 148 pass the two teeth 136 and 137. The inner beveled ends 148 of vanes 146 are in close cutting relationship to the beveled outer surface 154 of tooth 136. With reference to FIG. 29, any material that may be swept along (counterclockwise as viewed in FIG. 29) with a vane 147 will be presented against the serrated leading face 155 of the tooth. Note also that the bevel of the tooth and the angle of the leading face 155 tend to force such material toward the shroud plate and radially inward as the impeller is rotated.

At the opposite side, tooth 137 is not in particularly close cutting relationship with a vane 146 along any side or edge.

Referring to FIG. 33, and beginning with the upper portion of that figure showing tooth 136, vanes 147 also have beveled portions 148' which cooperate with the beveled radially outer surface 154 of tooth 136 to achieve a chopping action. Additionally, the base portions 149 of vanes 147 are in close cutting relationship to the flat adjacent surface or tip of tooth 136. At the radially inner side of tooth 136, the hub projection 150 passes close to the radially inner side of the tooth, but not in extremely close cutting relationship. Nevertheless, projection 150 helps to clear the space between the radially inner portion of tooth 136 and the impeller hub 131.

At the opposite side of the pump, shown toward the bottom of FIG. 33, both the base portion 149 and hub projection portion 150 of the diametrically opposite vane 147 are in close cutting relationship with the corresponding, immediately adjacent portions of tooth 137. However, the arcuate radially outer portion 162 of tooth 137 is not in close cutting relationship to the beveled inner end 148' of the vane.

It was mentioned above with reference to FIG. 32 and FIG. 29 that the action of vanes 146 and the leading face of tooth 136 tended to urge material radially inward toward the impeller hub, which may at first appear to be the opposite direction from that desired to clear the hub and seal area of the tough sinewy material. However, by fostering such action and movement, the material is ripped along the serrations of the leading face 155 of tooth 136, then carried toward tooth 137 which, in conjunction with vanes 147, achieves an abrupt chopping action of such materials. Also, if any material does tend to collect in the area of the hub, it is alternately urged inward by the leading face 155 of tooth 136 and then outward along the nonchopping leading face 163 of tooth 137, as best seen with reference to FIG. 29. The cutting action is similar to abrupt sawing of the material which clears the hub area, such that rotation of the impeller is not impeded and the seal integrity is not jeopardized. In combination with the cutting, slicing and chopping action achieved adjacent to the pump intake, the internal cutter adapts the pump for pumping and accommodating a wide variety of slurry-born refuse.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. In a centrifugal pump having an impeller rotatable about an axis, such impeller having a plurality of generally radially extending vanes and a central hub portion, and a pump casing including a bowl receiving the impeller and having an inlet side for intake of material into the pump bowl and a closed side opposite the inlet side, the improvement comprising the closed side of the pump bowl having a first cutter tooth projecting abruptly generally axially inward toward the impeller and located adjacent to the impeller hub portion, the impeller vanes including edges adjacent to the closed side of the pump bowl, said edges having portions adjacent to and in close cutting relationship to said first cutter tooth as the impeller is rotated.

2. In the pump defined in claim 1, a plurality of the impeller vanes having radially inner end portions in close cutting relationship to the first cutter tooth as the impeller is rotated.

3. In the pump defined in claim 2, the radially inner end portions of the plurality of impeller vanes and the first cutter tooth having cooperating surfaces beveled relative to the axis of rotation of the impeller at equal angles and in close cutting relationship as the impeller is rotated.

4. In the pump defined in claim 3, the radially inner end portions of the impeller vanes being beveled in a direction toward the closed side of the pump bowl and radially outward.

5. In the pump defined in claim 1, the impeller hub portion having an abrupt projection extending radially outward, the first cutter tooth having a radially inner portion in close cutting relationship to said projection as the impeller is rotated.

6. In the pump defined in claim 1, at least one of the impeller vanes having a base portion underlying the first cutter tooth and in close cutting relationship therewith as the impeller is rotated.

7. In the pump defined in claim 1, the first cutter tooth having a leading surface presented to the impeller vanes as the impeller is rotated, said leading surface being serrated.

8. In the pump defined in claim 7, the serrated surface of the first cutter tooth being angled outward and rearward relative to the direction of rotation of the impeller.

9. In the pump defined in claim 1, the leading surface of the first cutter tooth being angled outward and rearward relative to the direction of rotation of the impeller.

10. In the pump defined in claim 1, the leading surface of the first cutter tooth being angled outward and forward relative to the direction of rotation of the impeller.

11. In the pump defined in claim 1, the leading surface of the first cutter tooth being cupped.

12. In the pump defined in claim 1, a cutter ring carrying the first cutter tooth and mounted in the closed side of the pump bowl.

13. In the pump defined in claim 12, the closed side of the pump bowl having a counterbore, and the cutter ring being threaded into said counterbore.

14. In the pump defined in claim 1, a second cutter tooth projecting abruptly generally axially inward toward the impeller and located adjacent to the hub portion but spaced circumferentially from the first cutter tooth.

15. In the pump defined in claim 14, one of the first and second cutter teeth being offset radially relative to the other of the first and second cutter teeth.

16. In the pump defined in claim 14, one of the cutter teeth having a leading surface angled outward and forward relative to the direction of impeller rotation and the other of the cutter teeth having a leading surface angled outward and rearward relative to the direction of impeller rotation.

17. In a centrifugal pump having an impeller rotatable about an axis, such impeller having a plurality of generally radially extending vanes and a central hub portion, and a pump casing including a bowl receiving the impeller and having an inlet side for intake of material into the pump bowl and a closed side opposite the inlet side, the improvement comprising the closed side of the pump bowl having at least two cutter teeth each projecting abruptly generally axially inward toward the impeller and located adjacent to the impeller hub portion, the impeller vanes including edges adjacent to the closed side of the pump bowl and having portions in close cutting relationship to said cutter teeth as the impeller is rotated.

18. In the pump defined in claim 17, one of the cutter teeth being offset radially relative to the other of the cutter teeth.

19. In the pump defined in claim 17, one of the cutter teeth having a leading surface angled outward and forward relative to the direction of impeller rotation and the other of the teeth having a leading surface angled outward and rearward relative to the direction of impeller rotation.

20. In the pump defined in claim 17, the hub portion of the impeller having at least one projection extending radially outward, at least one of the cutter teeth having a radially inner surface in close cutting relationship to said hub projection as the impeller is rotated.

21. In the pump defined in claim 17, at least one of the impeller vanes having a base portion underlying and in close cutting relationship to at least one of the cutter teeth as the impeller is rotated.

* * * * *